US007350386B2

(12) United States Patent
Streubel

(10) Patent No.: US 7,350,386 B2
(45) Date of Patent: Apr. 1, 2008

(54) METHOD AND APPARATUS FOR MAKING TUBES

(75) Inventor: Wolfgang Streubel, Detmold (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 131 days.

(21) Appl. No.: 11/352,926

(22) Filed: Feb. 13, 2006

(65) Prior Publication Data

US 2007/0045236 A1 Mar. 1, 2007

(30) Foreign Application Priority Data

Feb. 11, 2005 (DE) ..... 10 2005 006 578

(51) Int. Cl.
*B21C 37/08* (2006.01)
*B23K 26/24* (2006.01)

(52) U.S. Cl. ..... 72/51; 72/368; 72/370.04; 219/61; 219/61.11; 228/146; 228/151

(58) Field of Classification Search ..... 219/61.11, 219/61.3, 158, 161, 59.1, 61; 228/146, 147, 228/151, 152, 153; 72/51, 368, 370.04, 379.2
See application file for complete search history.

(56) References Cited

U.S. PATENT DOCUMENTS

| | | | | | |
|---|---|---|---|---|---|
| 1,093,010 | A | * | 4/1914 | Ries | 219/61.6 |
| 2,515,179 | A | * | 7/1950 | Barger | 219/61 |
| 2,929,914 | A | * | 3/1960 | Ely | 219/61.11 |
| 2,943,179 | A | * | 6/1960 | Raiha | 219/61.11 |
| 3,241,347 | A | * | 3/1966 | Seeloff | 72/301 |
| 3,301,992 | A | * | 1/1967 | Seeloff | 219/105 |
| 3,590,622 | A | * | 7/1971 | Elge et al. | 72/209 |
| 3,937,383 | A | * | 2/1976 | Sawert | 228/115 |
| 3,973,717 | A | * | 8/1976 | Jensen | 228/144 |
| 4,148,426 | A | * | 4/1979 | Midzutani et al. | 228/146 |
| 4,905,885 | A | * | 3/1990 | Hellman, Sr. | 228/144 |
| 4,971,239 | A | * | 11/1990 | Tyler et al. | 228/146 |
| 5,011,064 | A | * | 4/1991 | Fuss | 228/151 |
| 5,657,922 | A | * | 8/1997 | Lowery et al. | 228/144 |
| 5,743,122 | A | * | 4/1998 | Rhodes et al. | 72/51 |
| 5,924,316 | A | * | 7/1999 | Streubel et al. | 72/51 |
| 6,098,869 | A | * | 8/2000 | Bonsen | 228/147 |
| 7,249,479 | B2 | * | 7/2007 | Burger | 72/51 |

FOREIGN PATENT DOCUMENTS

| | | | |
|---|---|---|---|
| DE | 85 36 655.2 | | 2/1986 |
| DE | 276 043 | A1 | 2/1990 |
| DE | 103 29 424.4 | | 7/2003 |
| JP | 05031534 | A * | 2/1993 |

* cited by examiner

*Primary Examiner*—Dmitry Suhol
(74) *Attorney, Agent, or Firm*—Henry M. Feiereisen; Ursula B. Day

(57) ABSTRACT

In a method of making a tube, a sheet metal blank is placed in a U-shaped cavity of a lower mold of a shaping tool, and pressed into the cavity by a ram to shape the blank into a U-shaped configuration. In a next process step, the U-shaped blank is formed between an upper mold and a lower mold of a molding press into a tubular configuration. The upper and lower molds of the molding press with accommodated tubular profile are then clamped together and the clamped upper and lower molds are then removed from the molding press. Subsequently, the confronting longitudinal edges of the tubular profile are welded together via an opening that provides access to the longitudinal edges. After separation of the upper mold from the lower mold, another shaping cycle may begin.

10 Claims, 1 Drawing Sheet

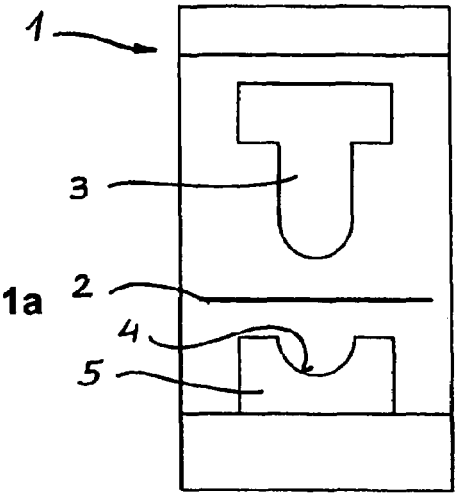
Fig. 1a
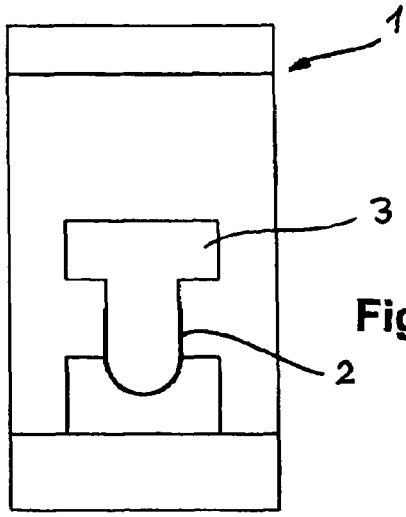
Fig. 1b
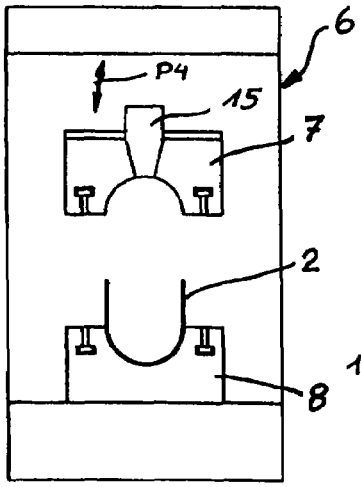
Fig. 2a
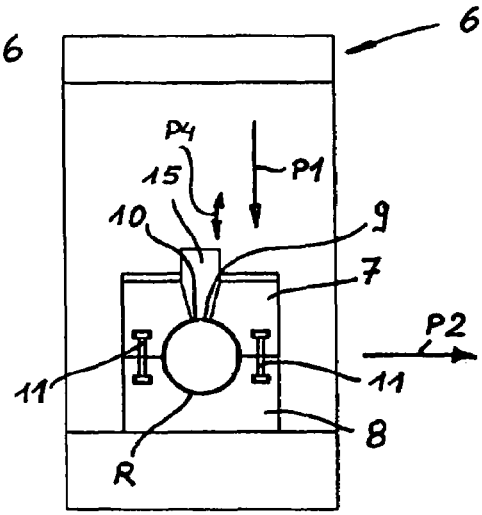
Fig. 2b
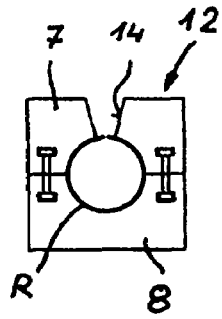
Fig. 2c
Fig. 3a
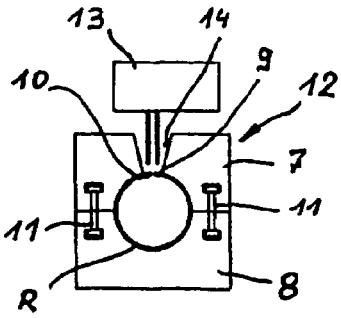
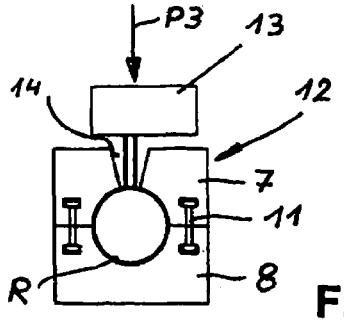
Fig. 3b

METHOD AND APPARATUS FOR MAKING TUBES

CROSS-REFERENCES TO RELATED APPLICATIONS

This application claims the priority of German Patent Application, Serial No. 10 2005 006 578.3, filed Feb. 11, 2005, pursuant to 35 U.S.C. 119(a)-(d), the content of which is incorporated herein by reference.

BACKGROUND OF THE INVENTION

The present invention relates, in general, to a method and apparatus for making tubes.

Nothing in the following discussion of the state of the art is to be construed as an admission of prior art.

DD 276 043 A1 discloses a method and apparatus for making thin-walled tubes from sheet metal blanks by using indirect lap welding. The apparatus includes a molding press having a shaping tool which is comprised of a lower forming piece, which has a semicircular cavity to embrace the blank from outside, a cylindrical mandrel with incorporated copper rail, and two upper forming pieces. A drawback of this construction is the need for the molding press to hold the shaping tool in position during lap welding so that the molding press cannot be used for further shaping operations.

It would therefore be desirable and advantageous to provide an improved method and apparatus for making a tube from a sheet metal blank to obviate prior art shortcomings and to operate more efficiently.

SUMMARY OF THE INVENTION

According to one aspect of the present invention, a method of making a tube, includes the steps of placing a sheet metal blank in a U-shaped cavity of a die of a shaping tool, pressing the blank into the cavity by a ram to shape the blank into a U-shaped configuration, shaping the U-shaped blank between an upper mold and a lower mold of a molding press into a tubular profile, clamping the upper and lower molds with accommodated tubular profile to one another, removing the clamped upper and lower molds from the molding press, welding confronting longitudinal edges of the tubular profile to one another via an opening in the upper mold that provides access to the longitudinal edges, and separating the upper mold from the lower mold for another shaping cycle.

The present invention resolves prior art problems by clamping the upper mold and the lower mold with accommodated tubular profile to one another, thereby in effect provide a unitary structure that can be removed from the molding press. As a result, the molding press continues to be available for further shaping operations. The welding operation of the confronting longitudinal edges of the tubular profile takes place outside the molding press while the tubular profile is still kept in the shaping tool. This can be realized as a result of the presence of the opening in the upper mold to provide access to the longitudinal edges and allow subsequent execution of the welding operation. Thus, a welding device can engage the upper mold through the opening and can be guided along the longitudinal edges of the tubular profile. After the longitudinal edges of the tubular profile have been welded together, the upper mold is separated from the lower mold, and both mold components are then ready for a new shaping cycle.

According to another feature of the present invention, a plurality of such upper and lower molds may be provided which can be shuttled back and forth by means of a suitable transport assembly between the molding press and welding station. Of course, also several such welding stations may be provided when the output of the molding press exceeds the capacity of one welding station. In general, the cycle times should be synchronized to enhance productivity.

According to another feature of the present invention, the clamped upper and lower molds can be transferred to a further molding press for subsequent unlocking. As an alternative, it is, of course, also possible to carry out the unlocking operation in the same molding press that also executes the clamping operation, i.e. the molding press that shapes the U-shaped blank to the tubular profile. In this case, the need for a separate station to unlock and remove the longitudinally welded tube is eliminated. After unlocking and removal of the tubular profile, the shaping tool can be immediately used for a next shaping cycle. During shaping of the blank into a tubular configuration, the opening is sealed by a sealing strip and thus prevented from adversely affecting the shaping operation. The sealing strip may remain in the molding press even after removal of the upper mold and thus is able to engage in a subsequently used upper mold that is placed in the molding press. This is advantageous because the longitudinal edges can be welded together immediately after removal of the clamped shaping tool, without requiring the added step to clear the opening.

According to another feature of the present invention, the welding of the longitudinal edges can be executed by a laser hybrid welding process. Laser hybrid welding is a combination of laser welding and arc welding and exploits the advantages of both these welding operations. While conventional laser welding has advantages in connection with speed welding and deep welding, arc welding provides advantages as a result of the additional material in connection with gap inspection and seam width. The use of laser hybrid welding process results in higher efficiency and better quality. In particular in an area of thin sheets, the welding speed can be increased by up to 500% compared to arc welding alone.

Welding of the longitudinal edges inside the shaping tool has also the added benefit that the tolerances of the components can be maintained precisely. This is required for laser welding. Thus, the need for separate clamps to secure the workpiece is eliminated.

While laser hybrid welding is currently preferred, it is of course also possible to apply other welding operations such as MAG arc welding (metal active gas welding), TIG welding (tungsten-inert gas welding), laser welding, electrode welding, plasma welding, or plasma hybrid welding.

According to another aspect of the present invention, an apparatus for making a tube includes a molding press including a shaping tool having an upper mold and a lower mold for shaping a blank into a substantially tubular profile, wherein the upper mold has an opening at a location to allow access to confronting longitudinal edges of the tubular profile, at least one welding device for welding the longitudinal edges of the tubular profile together via the opening, a sealing strip for detachably closing the opening, a clamping mechanism for securing the upper mold and the lower mold to one another.

According to another aspect of the present invention, a kit for making a tube includes a molding press, plural shaping tools constructed for cooperation with the molding press, each shaping tool having an upper mold and a lower mold for shaping a blank into a substantially tubular profile, wherein the upper mold has an opening at a location to allow access to confronting longitudinal edges of the tubular profile, at least one welding device for welding the longitudinal edges of the tubular profile together via the opening, a sealing strip for detachably closing the opening, and a clamping mechanism for securing the upper mold and the lower mold to one another.

BRIEF DESCRIPTION OF THE DRAWING

Other features and advantages of the present invention will be more readily apparent upon reading the following description of currently preferred exemplified embodiments of the invention with reference to the accompanying drawing, in which:

FIGS. 1*a*, 1*b* are schematic views of forming steps for shaping a sheet metal blank to a U-shaped configuration;

FIGS. 2*a*, 2*b* are schematic views of forming steps for shaping the U-shaped blank into a tubular configuration;

FIG. 2*c* is a schematic view of a shaped tool with shaped tubular profile; and FIGS. 3*a*, 3*b* are schematic views of processing steps for welding longitudinal edges of the tubular profile in a welding station.

DETAILED DESCRIPTION OF PREFERRED EMBODIMENTS

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1*a*, there is shown a schematic illustration of a molding press, generally designated by reference numeral 1, for shaping a sheet metal blank 2 in a first manufacturing step from a flat configuration to a U-shaped configuration. The molding press 1 includes a shaping tool having a ram 3 and a die 5 which is formed with a U-shaped cavity 4. After placing the flat blank 2 on the die 5, the ram 3 is lowered in the direction of the die 5 to force the blank 2 into the cavity 4 and thereby shape the blank 2 to assume the U-shaped configuration. This shaping step is shown in FIG. 1*b*.

A subsequent second manufacturing step transforms the U-shaped blank to a tubular profile R, as shown in FIGS. 2*a* and 2*b*. The U-shaped blank 2 of FIG. 1*b* is transferred to a second molding press, generally designated by reference numeral 6 and having a shaping tool 12 (FIG. 2*c*) which includes an upper mold 7 and a lower mold 8. The blank 2 is placed into a cavity of the lower mold 8, as shown in FIG. 2*a*. Subsequently, the upper mold 7 is moved in a direction of arrow P1 towards the lower mold 8 to shape the blank 2 into a tubular profile R. This is shown in FIG. 2*b*. During the shaping operation, the initially parallel legs of the U-shaped blank 2 are curved inwards so that their longitudinal edges 9, 10 confront one another in midsection of the upper mold 7. When the shaping tool 12 of the molding press 6 is closed, the upper mold 7 is clamped to the lower mold 8 by a locking means 11. As a result, a unitary structure is realized so that the shaping tool 12 can be removed from the molding press 6, as indicated by arrow P2. The clamped shaping tool 12 is shown in FIG. 2*c*. As a result, the molding press 6 is available for a further shaping process, whereas the clamped shaping tool 12 is transferred to a welding station, shown in FIG. 3*a* by way of a welding head 13.

The upper mold 7 is formed with an opening 14 which exposes the longitudinal edges 9, 10 of the tubular profile R so that access is provided for engagement by the welding head 13 in the direction of arrow P3 for welding the longitudinal edges 9, 10 together, as shown in FIG. 3*b*. After the welding operation, the tubular profile R is still held in the clamped shaping tool 12 which can then be returned to the molding press 6 for unlocking the shaping tool 12 or, optionally, to another molding press. Following release, the upper mold 7 is lifted from the lower mold 8 to allow expulsion of the tubular profile R from the lower mold 8. The second manufacturing step can now be repeated by placing another U-shaped blank 2 into the open shaping tool 12 for subsequent shaping to a tubular profile R.

As shown in particular in FIGS. 2*a*, 2*b*, the opening 14 in the upper mold 7 is closed by a sealing strip 15 during shaping of the U-shaped blank 2 to the tubular profile R. During this shaping operation, the sealing strip 15 is part of the cavity and can be moved in relation to the upper mold, as indicated by arrow P4. In other word, the sealing strip 15 has an inside curved configuration which complements the cavity defined by the upper and lower molds 7, 8, when the shaping tool 12 is closed. The sealing strip 15 remains in the molding press 6 so that the opening 14 is cleared for allowing access to the longitudinal edges 9, 10 of the tubular profile R, after the shaping tool 12 is removed from the molding press 6 and subsequently transferred to the welding station.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A method of making a tube, comprising the steps of:

placing a sheet metal blank in a U-shaped cavity of a die of a shaping tool;

pressing the blank into the cavity by a ram to shape the blank into a U-shaped configuration;

shaping the U-shaped blank between an upper mold and a lower mold of a molding press into a tubular profile;

clamping the upper and lower molds with accommodated tubular profile to one another;

removing the clamped upper and lower molds from the molding press;

welding confronting longitudinal edges of the tubular profile to one another via an opening in the upper mold that provides access to the longitudinal edges; and separating the upper mold from the lower mold for another shaping cycle.

2. The method of claim 1, including a plurality of upper and lower molds, and further comprising the step of shuttling the upper and lower molds back and forth between the molding press and welding station.

3. The method of claim 1, and further comprising the step of transferring the clamped upper and lower molds to a further molding press for subsequent unlocking.

4. The method of claim 1, wherein the separating step is executed in the molding press.

5. The method of claim 1, and further comprising the step of sealing the opening in the upper mold during the shaping step.

6. The method of claim 1, wherein the welding step is executed by a laser hybrid welding process.

7. Apparatus for making a tube, comprising:

a molding press including a shaping tool having an upper mold and a lower mold for shaping a blank into a substantially tubular profile, said upper mold having an opening at a location to allow access to confronting longitudinal edges of the tubular profile;

at least one welding device for welding the longitudinal edges of the tubular profile together via the opening;

a sealing strip for detachably closing the opening;

a clamping mechanism for securing the upper mold and the lower mold to one another.

8. The apparatus of claim 7, wherein the sealing strip is mounted to the molding press so as to close the opening, when the blank is shaped into the tubular profile.

9. The apparatus of claim 7, wherein the sealing strip has an inside curved configuration to complement a configuration of a cavity defined by the upper and lower molds, when the shaping tool is closed.

10. A kit for making a tube, comprising:

a molding press;

plural shaping tools constructed for cooperation with the molding press, each shaping tool having an upper mold and a lower mold for shaping a blank into a substantially tubular profile, said upper mold having an opening at a location to allow access to confronting longitudinal edges of the tubular profile;

at least one welding device for welding the longitudinal edges of the tubular profile together via the opening;

a sealing strip for detachably closing the opening; and a clamping mechanism for securing the upper mold and the lower mold to one another.

* * * * *